US010534309B2

(12) United States Patent
Sakurai

(10) Patent No.: US 10,534,309 B2
(45) Date of Patent: Jan. 14, 2020

(54) POWER SUPPLY APPARATUS AND IMAGE FORMING APPARATUS

(71) Applicant: CANON KABUSHIKI KAISHA, Tokyo (JP)

(72) Inventor: Toshio Sakurai, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/205,041

(22) Filed: Nov. 29, 2018

(65) Prior Publication Data

US 2019/0179250 A1 Jun. 13, 2019

(30) Foreign Application Priority Data

Dec. 7, 2017 (JP) ..... 2017-235476

(51) Int. Cl.
*G03G 15/00* (2006.01)

(52) U.S. Cl.
CPC ..... *G03G 15/80* (2013.01)

(58) Field of Classification Search
CPC .... G03G 15/00; G03G 15/80; G03G 15/2039; G03G 21/398
USPC ..... 399/37, 38, 67–69, 75, 88
See application file for complete search history.

(56) References Cited

U.S. PATENT DOCUMENTS 6,665,501 B2 * 12/2003 Okada ..... G03G 15/0896 399/27
8,494,382 B2 * 7/2013 Na ..... G03G 15/5004 399/37
9,335,709 B2 5/2016 Iwasaki et al.

FOREIGN PATENT DOCUMENTS

JP 2007-093595 A 4/2007
JP 2015-132922 A 7/2015

* cited by examiner

*Primary Examiner* — Hoan H Tran
(74) *Attorney, Agent, or Firm* — Canon U.S.A. Inc., IP Division

(57) ABSTRACT

A power supply apparatus according to the present disclosure includes a first circuit, a second circuit isolated from the first circuit, an adjustment unit configured to adjust power supplied to a load, a first controller, a detection unit configured to detect a parameter related to the power supplied to the load, a first communication unit, a second communication unit configured to perform wireless communication with the first communication unit, and a second controller. The first communication unit is operated by power supplied by a signal generated in the first communication unit due to a signal output from the second controller. The first communication unit transmits, to the second communication unit, information about a result of detection by the detection unit. The second controller supplies the first controller with a signal for controlling the adjustment unit. The first controller controls the adjustment unit based on the signal.

13 Claims, 6 Drawing Sheets

POWER SUPPLY APPARATUS AND IMAGE FORMING APPARATUS

BACKGROUND OF THE INVENTION

Field of the Invention

The present disclosure generally relates to supplying power to a load and more specifically to a power supply apparatus that controls power to be supplied to a load, and an image forming apparatus.

Description of the Related Art

In an apparatus that is operated by power supplied from a commercial power supply, there has been known a configuration in which a voltage of the commercial power supply that is input to a primary side and a current thereof that flows through the primary side are detected on a secondary side isolated from the primary side.

U.S. Pat. No. 9,335,709 discusses a configuration of an image forming apparatus in which a voltage applied to a fixing heater provided on a primary side is detected on a secondary side via a transformer. U.S. Pat. No. 9,335,709 also discusses a configuration in which a central processing unit (CPU) on the secondary side is informed of temperature information about the fixing heater. Based on an informed detection result, the CPU controls the temperature of the fixing heater by controlling a circuit (phase control circuit) provided on the primary side for controlling the temperature of the fixing heater.

In U.S. Pat. No. 9,335,709, the transformer has a function of isolating the primary side from the secondary side and a function of transforming the voltage on the primary side and outputting the voltage to the secondary side. As a frequency of the voltage to be transformed decreases, the number of windings of the transformer needs to be increased, whereby a larger transformer is required.

In U.S. Pat. No. 9,335,709, the frequency of the voltage to be transformed is 50 Hz or 60 Hz, which is a relatively low frequency. In other words, the use of the transformer in the configuration discussed in U.S. Pat. No. 9,335,709 may cause an increase in size of the image forming apparatus and an increase in costs.

In a case where the CPU on the secondary side is informed of the temperature information about the fixing heater provided on the primary side, a configuration for isolating the primary side from the secondary side is required in a circuit that informs the CPU of the temperature information. In a case where the CPU on the secondary side controls the phase control circuit on the primary side, a configuration for isolating the primary side from the secondary side is required in a circuit that controls the phase control circuit.

Provision of the configuration for isolating the primary side from the secondary side in each circuit as described above may cause an increase in the size of the image forming apparatus and an increase in costs.

SUMMARY OF THE INVENTION

In view of the above, the present disclosure is directed to optimizing the performance of the image forming apparatus without increasing its size.

According to an aspect of the present disclosure, a power supply apparatus including a first circuit connected to a predetermined power supply and a second circuit isolated from the first circuit includes an adjustment unit provided in the first circuit and configured to adjust power supplied to a load from the predetermined power supply, a first controller provided in the first circuit and configured to control the adjustment unit, a detection unit provided in the first circuit and configured to detect a parameter related to the power supplied to the load, a first communication unit provided in the first circuit and connected to the first controller, a second communication unit provided in the second circuit, isolated from the first communication unit, and configured to perform wireless communication with the first communication unit, and a second controller provided in the second circuit and connected to the second communication unit. The first communication unit is operated by power supplied by a signal generated in the first communication unit due to a signal output from the second controller to the second communication unit. The first communication unit transmits, to the second communication unit, information about a result of detection by the detection unit. The second controller supplies the first controller with a signal for controlling the adjustment unit via the first communication unit and the second communication unit based on the information transmitted to the second communication unit. The first controller controls the adjustment unit based on the signal.

Further features of the present disclosure will become apparent from the following description of exemplary embodiments with reference to the attached drawings.

DESCRIPTION OF THE EMBODIMENTS

Exemplary embodiments of the present disclosure will be described below with reference to the drawings. Shapes of components described in the exemplary embodiments, a relative arrangement of the components, and the like may be appropriately modified in accordance with a configuration of an apparatus to which the present disclosure is applied, and various conditions. The scope of the present disclosure is not to be limited to the following exemplary embodiments.

<Image Forming Apparatus>

Figure 1:
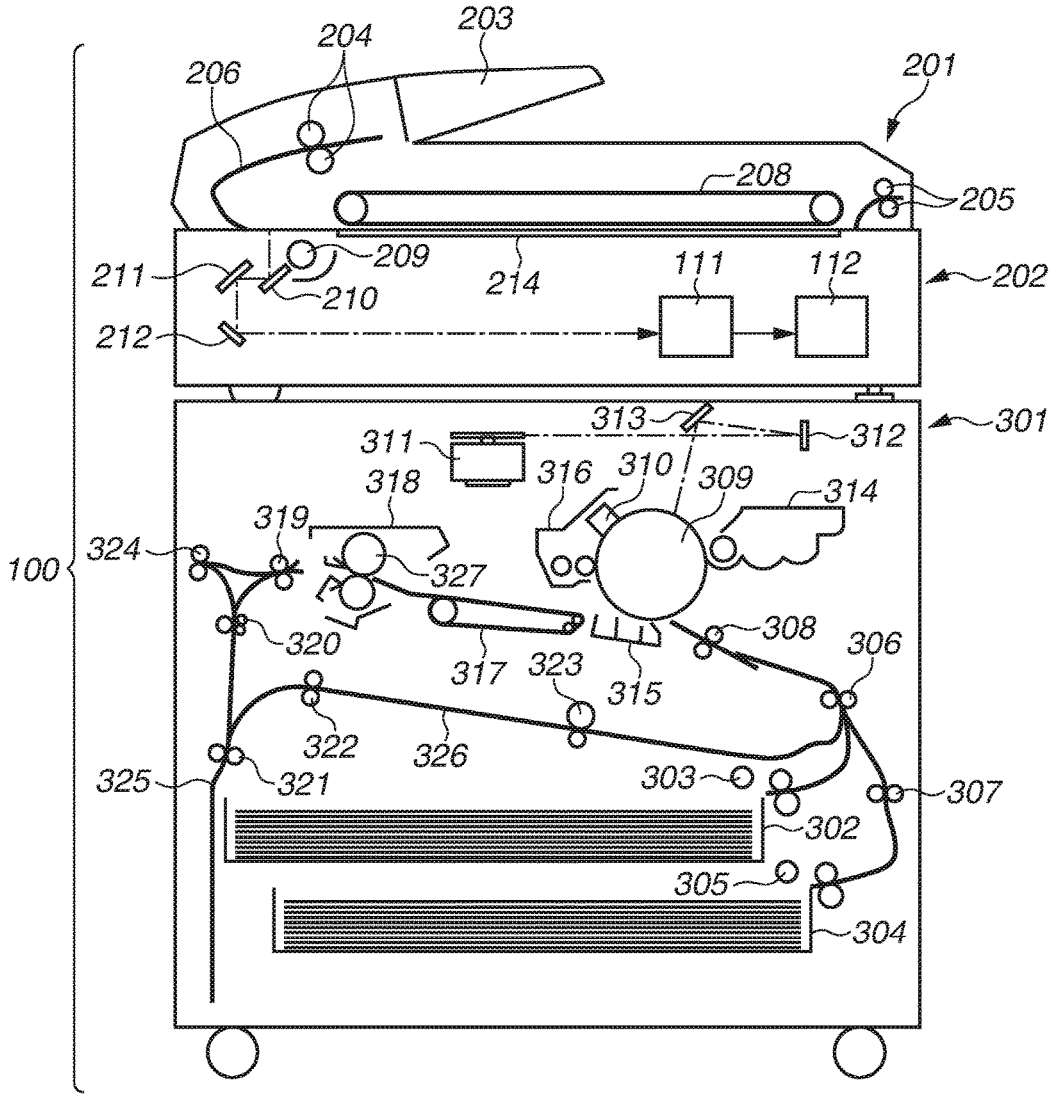
FIG. 1 is a sectional view illustrating an image forming apparatus according to a first exemplary embodiment.

FIG. 1 is a sectional view illustrating a configuration of an electrophotographic monochrome copying machine (hereinafter referred to as an image forming apparatus) 100 including a sheet conveyance device according to a first exemplary embodiment. The image forming apparatus 100 is not limited to the copying machine and may also be, for example, a facsimile machine, a printing machine, or a printer. The recording method thereof is not limited to the electrophotographic method and may also be, for example, an inkjet method. The type of the image forming apparatus 100 may be either the monochrome type or a color type.

A configuration and a function of the image forming apparatus 100 will be described below with reference to FIG. 1. As illustrated in FIG. 1, the image forming apparatus 100 includes a document feeding device 201, a reading device 202, and an image printing device 301.

Documents stacked on a document stacking unit 203 of the document feeding device 201 are fed one by one by feed rollers 204 and are conveyed along a conveyance guide 206 onto a glass platen 214 of the reading device 202. Further, the documents are conveyed at a constant speed by a conveyance belt 208 and are discharged onto a discharge tray (not illustrated) by discharge rollers 205. Reflected light from a document image that is illuminated by an illumination system 209 at a reading position of the reading device 202 is guided to an image reading unit 111 by an optical system including reflection mirrors 210, 211, and 212, and is converted into an image signal by the image reading unit 111. The image reading unit 111 includes lenses, a charge-coupled device (CCD) sensor, which is a photoelectric conversion element, and a driving circuit for driving the CCD sensor. The image signal output from the image reading unit 111 is subjected to various kinds of correction processing by an image processing unit 112, which includes a hardware device such as an application specific integrated circuit (ASIC). Then, the image signal is output to the image printing device 301. A document reading process is performed as described above. More specifically, the document feeding device 201 and the reading device 202 function as a document reading device.

There are two different document reading modes, i.e., a first reading mode and a second reading mode. The first reading mode is a mode in which the illumination system 209 and the optical system that are fixed at predetermined positions read an image on a document being conveyed at a constant speed. The second reading mode is a mode in which the illumination system 209 and the optical system that move at a constant speed read an image on a document placed on the glass platen 214 of the reading device 202. Normally, an image on a sheet-type document is read in the first reading mode, and an image on a bound document such as a book and a booklet is read in the second reading mode.

Sheet storage trays 302 and 304 are provided in the image printing device 301. Different kinds of recording media can be stored in the sheet storage trays 302 and 304. For example, A4-size sheets of plain paper are stored in the sheet storage tray 302 and A4-size sheets of thick paper are stored in the sheet storage tray 304. An image is formed on a recording medium by the image forming apparatus 100. Examples of the recording medium include a sheet of paper, a resin sheet, a cloth, an overhead projector (OHP) sheet, and a label.

The recording medium stored in the sheet storage tray 302 is fed by a feed roller 303 and is sent to registration rollers 308 by conveyance rollers 306. A recording medium stored in the sheet storage tray 304 is fed by a feed roller 305 and is sent to the registration rollers 308 by conveyance rollers 307 and the conveyance rollers 306.

An image signal output from the reading device 202 is input to an optical scanning apparatus 311 including a semiconductor laser and a polygon mirror.

An outer peripheral surface of a photoconductive drum 309 is charged by a charger 310. After the outer peripheral surface of the photoconductive drum 309 is charged, the outer peripheral surface of the photoconductive drum 309 is irradiated with laser light, which corresponds to the image signal input from the reading device 202 to the optical scanning apparatus 311, from the optical scanning apparatus 311 via the polygon mirror and mirrors 312 and 313. As a result, an electrostatic latent image is formed on the outer peripheral surface of the photoconductive drum 309. A charging method using, for example, a corona charger or a charging roller is used to charge the surface of the photoconductive drum 309.

Then, a developer unit 314 develops the electrostatic latent image using toner to form a toner image on the outer peripheral surface of the photoconductive drum 309. The toner image formed on the surface of the photoconductive drum 309 is transferred onto the recording medium by a transfer charger 315 provided at a position (transfer position) facing the photoconductive drum 309. In synchronization with a transfer timing, the registration rollers 308 send the recording medium to the transfer position.

As described above, the recording medium with the toner image transferred thereon is sent to a fixing unit 318 by a conveyance belt 317 and is heated and pressurized by the fixing unit 318, whereby the toner image is fixed onto the recording medium. In this manner, an image is formed on the recording medium by the image forming apparatus 100.

In a case where image formation is performed in a one-side printing mode, the recording medium that has passed through the fixing unit 318 is discharged onto the discharge tray (not illustrated) by discharge rollers 319 and 324. In a case where the image formation is performed in a double-sided printing mode, a first surface of the recording medium is subjected to fixing processing by the fixing unit 318, and the recording medium is conveyed to a reverse path 325 by the discharge rollers 319, conveyance rollers 320, and reverse rollers 321. Then, the recording medium is conveyed again to the registration rollers 308 by conveyance rollers 322 and 323, and an image is formed on a second surface of the recording medium by the above-described method. After that, the recording medium is discharged onto the discharge tray (not illustrated) by the discharge rollers 319 and 324.

In a case where the recording medium with an image formed on the first surface thereof is discharged to the outside of the image forming apparatus 100 in a face-down state, the recording medium that has passed through the fixing unit 318 passes through the discharge rollers 319 and is conveyed in a direction toward the conveyance rollers 320. Then, rotation of the conveyance rollers 320 is reversed immediately before a trailing edge of the recording medium passes through a nip portion of the conveyance rollers 320. As a result, the recording medium with the first surface thereof facing down passes through the discharge rollers 324 and is discharged to the outside of the image forming apparatus 100.

The configuration and functions of the image forming apparatus 100 have been described above.

Figure 2:
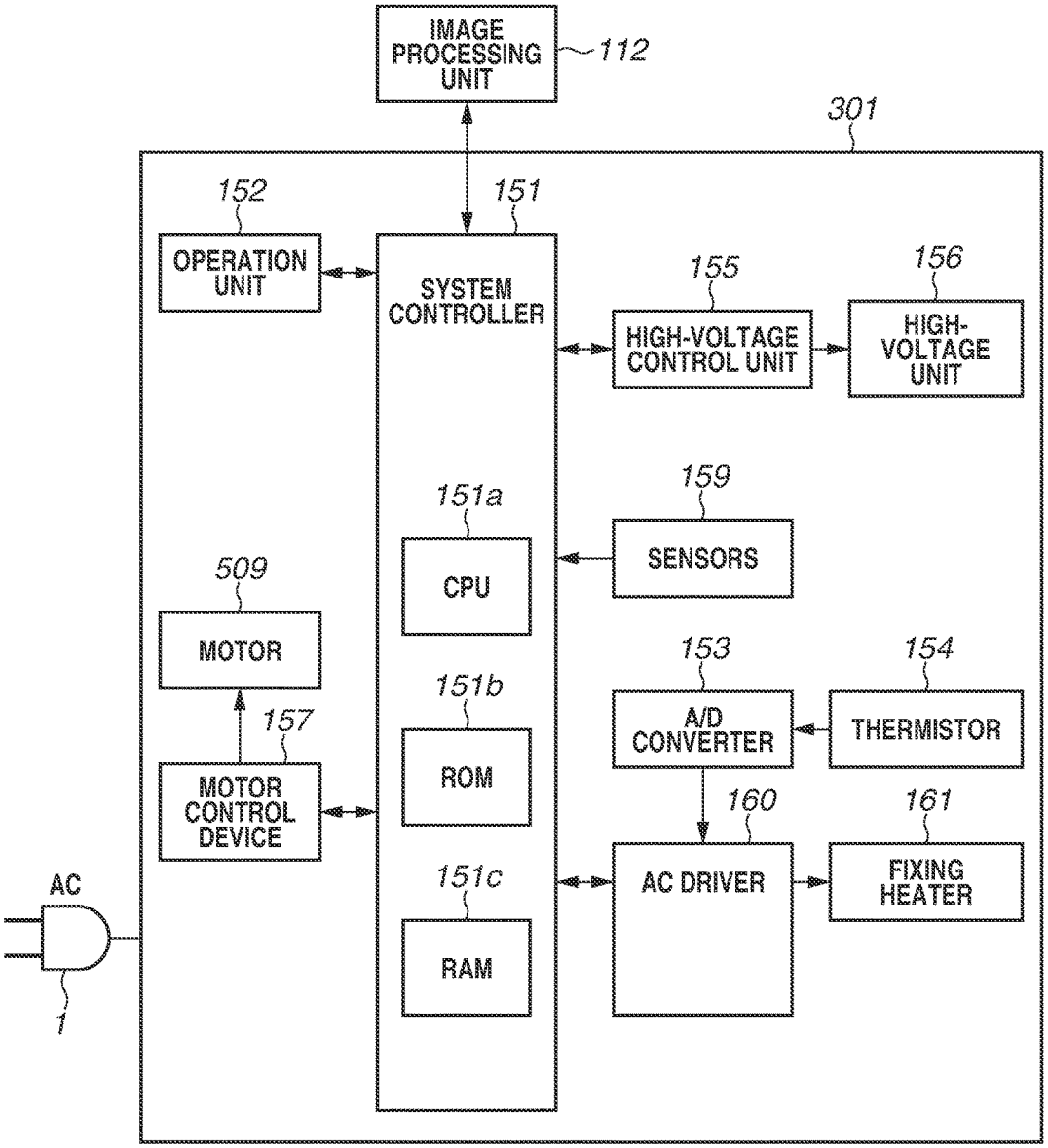
FIG. 2 is a block diagram illustrating a control configuration of the image forming apparatus according to the first exemplary embodiment.

FIG. 2 is a block diagram illustrating a control configuration example of the image forming apparatus 100. As illustrated in FIG. 2, the image forming apparatus 100 is connected to an alternating current (AC) power supply 1, which is a commercial power supply. Various units provided in the image forming apparatus 100 are operated by power supplied from the AC power supply 1. As illustrated in FIG. 2, a system controller 151 includes a central processing unit (CPU) 151*a*, a read only memory (ROM) 151*b*, and a random access memory (RAM) 151*c*. The system controller 151 is connected to the image processing unit 112, an operation unit 152, a high-voltage control unit 155, a motor control device 157, sensors 159, and an AC driver 160. The system controller 151 can transmit and receive data and commands to and from the units connected to the system controller 151.

The CPU 151*a* reads various programs stored in the ROM 151*b* and executes the programs, thereby executing various sequences related to a predetermined image formation sequence.

The RAM 151*c* is a storage device. The RAM 151*c* stores various kinds of data such as a setting value for the high-voltage control unit 155, a command value for the motor control device 157, and information received from the operation unit 152.

The system controller 151 transmits setting value data for various devices provided in the image forming apparatus 100 to the image processing unit 112. The setting value data is necessary for image processing in the image processing unit 112. In addition, the system controller 151 receives a signal from the sensors 159 and sets a setting value for the high-voltage control unit 155 based on the received signal.

The high-voltage control unit 155 supplies a voltage necessary for a high-voltage unit 156 (charger 310, developer unit 314, transfer charger 315, etc.) according to the setting value set by the system controller 151.

The motor control device 157 controls a motor 509, which drives a load provided in the image forming apparatus 100, in response to a command output from the CPU 151*a*. FIG. 2 illustrates only the motor 509 as a motor for the image forming apparatus 100; however, in practice, a plurality of motors is provided in the image forming apparatus 100. One motor control device 157 may be configured to control a plurality of motors. Although FIG. 2 illustrates only one motor control device 157, two or more motor control devices may be provided in the image forming apparatus 100.

An analog-to-digital (A/D) converter 153 receives a detection signal detected by a thermistor 154 for detecting temperature of a fixing heater 161, converts the detection signal from an analog signal into a digital signal, and transmits the digital signal to the AC driver 160. The AC driver 160 controls the fixing heater 161 based on the digital signal received from the A/D converter 153 so that the temperature of the fixing heater 161 is controlled to attain the temperature required to perform fixing processing. The fixing heater 161 is a heater used in fixing processing and is included in the fixing unit 318.

The system controller 151 controls the operation unit 152 to display, on a display unit of the operation unit 152, an operation screen for allowing a user to set, for example, a type of the recording medium to be used (hereinafter referred to as a sheet type). The system controller 151 receives information set by the user from the operation unit 152 and controls an operation sequence of the image forming apparatus 100 based on the information set by the user. The system controller 151 transmits information indicating a state of the image forming apparatus 100 to the operation unit 152. The information indicating the state of the image forming apparatus 100 refers to information about, for example, the number of sheets for image formation, progress of an image forming operation, and a sheet jam, double feed, or the like in the document feeding device 201 and the image printing device 301. The operation unit 152 displays the information received from the system controller 151 on the display unit.

As described above, the system controller 151 controls the operation sequence of the image forming apparatus 100.

<AC Driver>

Figure 3:
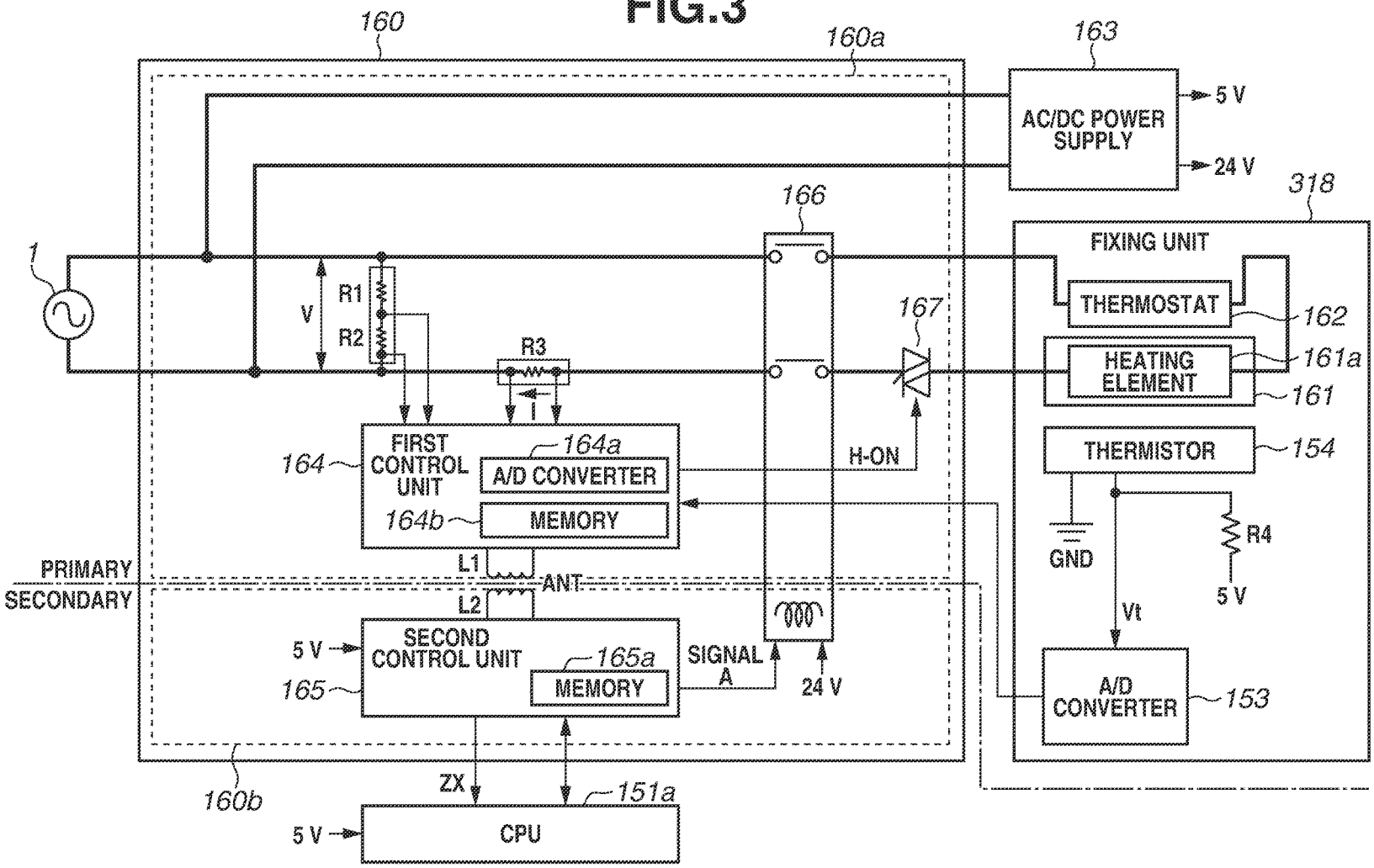
FIG. 3 is a control block diagram illustrating a configuration of an alternating current (AC) driver according to the first exemplary embodiment.

FIG. 3 is a control block diagram illustrating the configuration of the AC driver 160. The AC driver 160 includes a first circuit 160*a* that is connected to the AC power supply 1, and a second circuit 160*b* that is isolated from the first circuit 160*a*. As illustrated in FIG. 3, the first circuit 160*a* is included in a primary side of the AC driver 160, and the second circuit 160*b* is included in a secondary side of the AC driver 160.

The AC driver 160 includes a relay circuit 166, a triac 167, a first control unit 164, and a second control unit 165. The relay circuit 166 and the triac 167 control power supply from the AC power supply 1 to the fixing unit 318. The first control unit 164 detects a voltage V supplied from the AC power supply 1 and a current I flowing through the fixing heater 161, and controls the triac 167 based on a detection result. The second control unit 165 controls the relay circuit 166.

As illustrated in FIG. 3, the first control unit 164 is isolated from the second control unit 165. The first control unit 164 is provided in the first circuit 160*a*, and the second control unit 165 is provided in the second circuit 160*b*. The first control unit 164 is electromagnetically coupled to the second control unit 165 via an antenna ANT. The second control unit 165 is connected to the CPU 151*a* and is controlled by the CPU 151*a*. The antenna ANT will be described below.

As illustrated in FIG. 3, the voltage output from the AC power supply 1 is also input to an AC/DC power supply 163. The AC/DC power supply 163 converts an AC voltage output from the AC power supply 1 into, for example, DC voltages of 5 V and 24 V, and outputs the DC voltages. The DC voltage of 5 V is supplied to the CPU 151*a* and the second control unit 165. The DC voltage of 24 V is supplied to the relay circuit 166. The DC voltages of 5 V and 24 V are also supplied to various devices provided in the image forming apparatus 100. The voltage output from the AC/DC power supply 163 is not supplied to the first control unit 164. The first control unit 164 is supplied with power from the second control unit 165 via the antenna ANT in a state where the first control unit 164 is isolated from the second control unit 165. A specific configuration thereof will be described below.

The relay circuit 166 is controlled by a signal A that is output from the second control unit 165. For example, when the signal A='H' is output from the second control unit 165, the relay circuit 166 allows power to be supplied from the AC power supply 1 to the fixing unit 318. When the signal A='L' is output from the second control unit 165, the relay circuit 166 interrupts power supply from the AC power supply 1 to the fixing unit 318. For example, when the current flowing through the fixing heater 161 is higher than a predetermined value (i.e., during occurrence of an abnormality), the signal A='L' is output to the relay circuit 166. The second control unit 165 outputs the signal A in response to a command from the CPU 151*a*.

The first control unit 164 controls the triac 167 by using an H-ON signal. More specifically, when the H-ON signal='H' is output from the first control unit 164, the triac 167 is brought into an ON-state.

By the triac 167 being controlled in the manner described above, power is supplied to the fixing heater 161. The amount of power supplied to the fixing heater 161 is adjusted by controlling a timing at which the triac 167 is brought into the ON-state.

<Temperature Control for Fixing Heater>

A method for controlling the temperature of the fixing heater 161 will be described below. The power output from the AC power supply 1 is supplied to a heating element 161*a*, which is provided inside the fixing heater 161 provided in the fixing unit 318, via the AC driver 160.

The fixing unit 318 includes a thermostat 162. The thermostat 162 has a function of interrupting power supply to the heating element 161*a* if the thermostat 162 reaches a predetermined temperature.

The thermistor 154 that detects the temperature of the fixing heater 161 is provided in the vicinity of the fixing heater 161. As illustrated in FIG. 3, the thermistor 154 is connected to a ground (GND). The thermistor 154 has a characteristic that, for example, a resistance value decreases as a temperature thereof increases. A voltage Vt between both ends of the thermistor 154 changes as the temperature of the thermistor 154 changes. The temperature of the fixing heater 161 is detected by detecting the voltage Vt. The fixing unit 318 is included in the primary side.

The voltage Vt, which is an analog signal output from the thermistor 154, is input to the A/D converter 153. The A/D converter 153 converts the voltage Vt from the analog signal into a digital signal and outputs the digital signal to the first control unit 164.

The first control unit 164 samples the voltage Vt, which is output from the A/D converter 153, at a predetermined period T (e.g., 50 μs), and stores the sampled voltage Vt in a memory 164*b*. The first control unit 164 updates the voltage Vt stored in the memory 164*b* and stores the updated voltage Vt in the memory 164*b*.

The first control unit 164 detects the voltage V (voltage V between both ends of a resistor R2) supplied from the AC power supply 1. The first control unit 164 detects the current I flowing through the heating element 161*a* based on the voltage between the both ends of the resistor R2.

The first control unit 164 includes an A/D converter 164*a* that converts the input voltage V and the current I from an analog value into a digital value. The first control unit 164 samples the voltage V and the current I, which are converted by the A/D converter 164*a*, at the predetermined period T (e.g., 50 μs). The first control unit 164 performs summations of $V^2$, $I^2$, and V*I as given by the following formulas (1) to (3) each time the voltage V and the current I are sampled.

$$\Sigma V(n)^2 \tag{1}$$

$$\Sigma I(n)^2 \tag{2}$$

$$\Sigma V(n)I(n) \tag{3}$$

The first control unit 164 stores summed values in the memory 164*b*.

The first control unit 164 detects a timing at which the voltage V changes from a negative value to a positive value (hereinafter referred to as a zero crossing timing).

At the zero crossing timing, the first control unit 164 calculates an effective value Vrms of the voltage V, an effective value Irms of the current I, and an effective value Prms of V*I (=P) by the following formulas (4) to (6).

$$Vrms = \sqrt{\frac{1}{N}\sum_{n=l}^{N} V(n)^2} \tag{4}$$

$$Irms = \sqrt{\frac{1}{N}\sum_{n=l}^{N} I(n)^2} \tag{5}$$

-continued $$Prms = \frac{I}{N}\sum_{n=1}^{N} V(n)I(n) \tag{6}$$

The first control unit 164 stores the calculated effective values Vrms, Irms, and Prms in the memory 164*b*. The first control unit 164 resets the summed values of $V^2$, $I^2$, and V*I, which are stored in the memory 164*b*, each time the effective values Vrms, Irms, and Prms are calculated.

At the zero crossing timing, the first control unit 164 informs the second control unit 165, via the antenna ANT, of the effective values Vrms, Irms, and Prms and the voltage Vt stored in the memory 164*b* and information that the zero crossing timing is reached by a method described below.

The second control unit 165 stores the effective values Vrms, Irms, and Prms and the voltage Vt, which are acquired from the first control unit 164, in a memory 165*a*. The second control unit 165 informs the CPU 151*a* that the zero crossing timing is reached (signal ZX).

When the CPU 151*a* is informed by the second control unit 165 that the zero crossing timing is reached, the CPU 151*a* acquires the effective values Vrms, Irms, and Prms and the voltage Vt stored in the memory 165*a* of the second control unit 165. Thus, the CPU 151*a* acquires the effective values Vrms, Irms, and Prms and the voltage Vt at every zero crossing timing. In other words, in the present exemplary embodiment, the signal ZX is a signal serving as a trigger for the CPU 151*a* to acquire the effective values Vrms, Irms, and Prms and the voltage Vt.

The CPU 151*a* controls the temperature of the fixing heater 161 by controlling the triac 167 through the first control unit 164 and the second control unit 165 based on the effective values Vrms, Irms, and Prms and the voltage Vt, which are acquired from the second control unit 165. A specific method for controlling the temperature of the fixing heater 161 will be described below.

Figure 4:
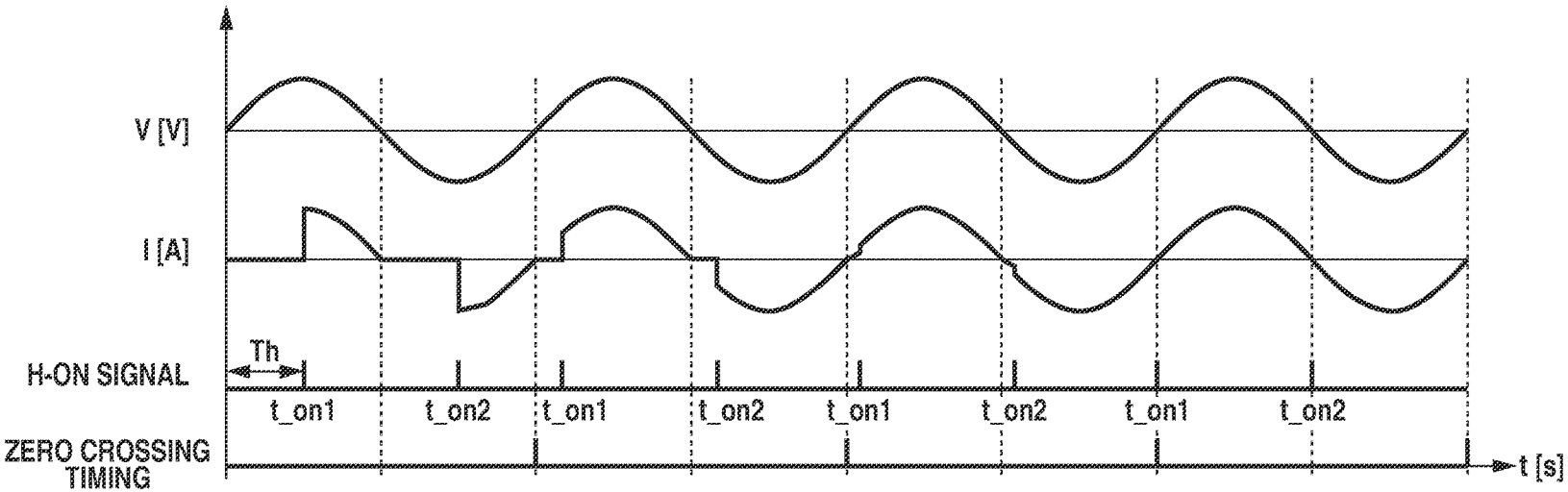
FIG. 4 is a time chart illustrating a voltage V of an AC power supply, a current I flowing through a heating element, an H-ON signal output from a second control unit, and a zero crossing timing.

FIG. 4 is a time chart illustrating the voltage V of the AC power supply 1, the current I flowing through the heating element 161*a*, the H-ON signal output from the second control unit 165, and the zero crossing timing. As illustrated in FIG. 4, a period Tzx of the zero crossing timing corresponds to a voltage period of the AC power supply 1.

As illustrated in FIG. 4, an amount of current flowing (amount of power supplied) through the heating element 161*a* is controlled by controlling a time Th from the zero crossing timing to a timing t_on1 at which the H-ON signal='H' is output. More specifically, for example, as the time Th becomes shorter, the amount of current flowing through the heating element 161*a* becomes larger. In other words, as the time Th is controlled to become shorter, the temperature of the fixing heater 161 becomes higher.

In the present exemplary embodiment, the CPU 151*a* controls the amount of current flowing through the heating element 161*a* by controlling the time from the zero crossing timing to the timing t_on1 via the first control unit 164 and the second control unit 165. As a result, the CPU 151*a* can control the temperature of the fixing heater 161. In the present exemplary embodiment, the triac 167 is controlled in such a manner that the current, which is in an amount that is equal to the amount of a current flowing due to the output of the H-ON signal='H' at the timing t_on1 and which has an opposite polarity to the current, flows through the heating element 161*a*. More specifically, as illustrated in FIG. 4, the H-ON signal='H' is output also at a timing t_on2 at which a time Tzx/2 has elapsed from the timing t_on1 (i.e., a timing after a half period of the voltage of the AC power supply 1).

Figure 5:
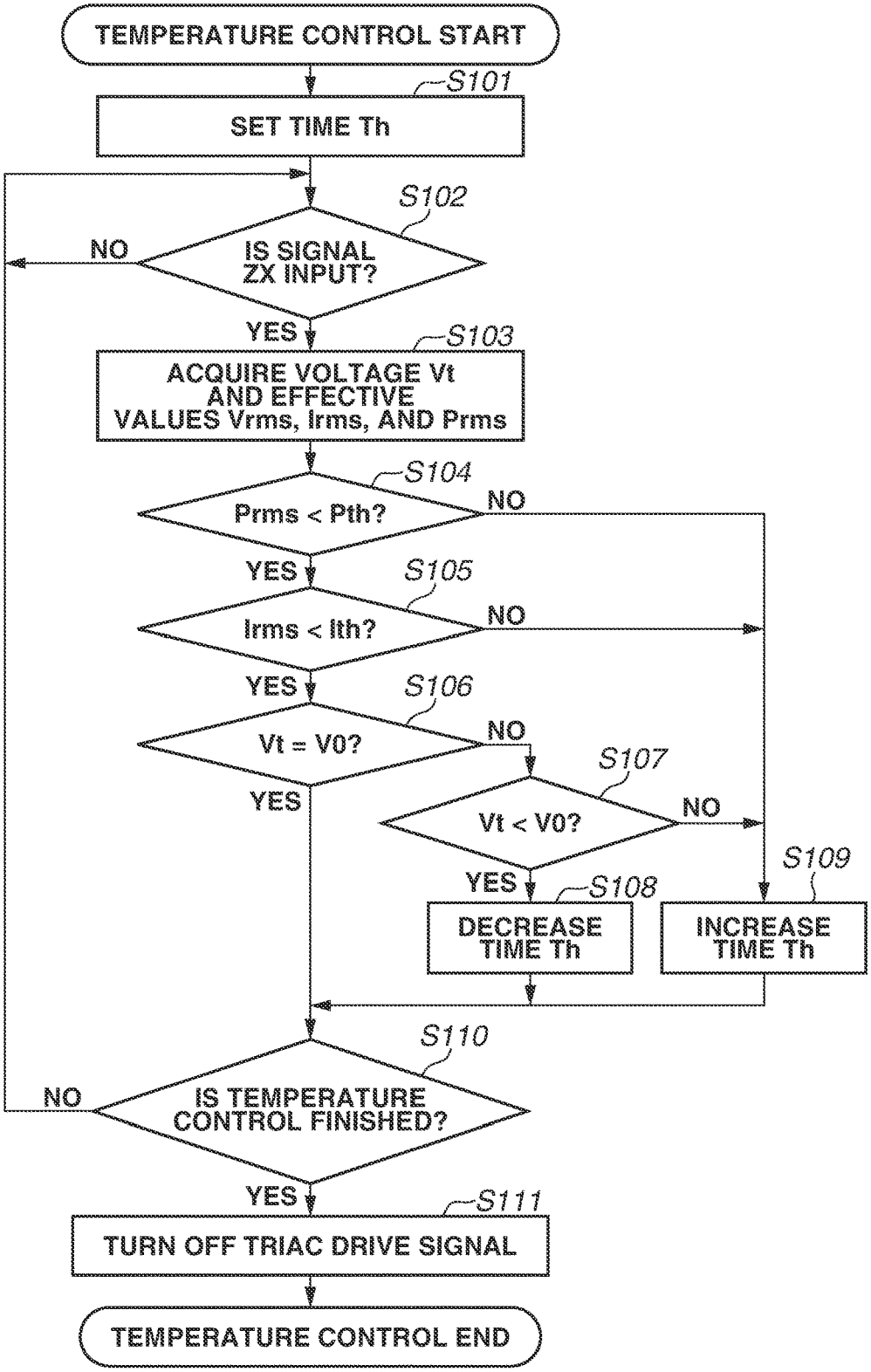
FIG. 5 is a flowchart illustrating a method for controlling a temperature of a fixing heater according to the first exemplary embodiment.

FIG. 5 is a flowchart illustrating the method for controlling the temperature of the fixing heater 161. Processing for controlling the temperature of the fixing heater 161 according to the present exemplary embodiment will be described below with reference to FIG. 5. The processing illustrated in the flowchart is executed by the CPU 151*a*. The processing illustrated in the flowchart is executed, for example, when the image forming apparatus 100 is started.

In step S101, the CPU 151*a* sets the time Th based on, for example, a difference value between the voltage Vt acquired from the second control unit 165 and a voltage V0 corresponding to a target temperature of the fixing heater 161, and informs the second control unit 165 of the time Th. The second control unit 165 informs the first control unit 164 of the set time Th via the antenna ANT. The first control unit 164 outputs the H-ON signal based on the time Th informed by the second control unit 165.

Next, in step S102, if the signal ZX is input to the CPU 151*a* from the second control unit 165 (YES in step S102), the processing proceeds to step S103. In step S103, the CPU 151*a* acquires the effective values Vrms, Irms, and Prms and the voltage Vt stored in the memory 165*a* of the second control unit 165.

Then, in step S104, if the effective value Prms of the power is greater than or equal to a threshold Pth (Prms≥Pth) (NO in step S104), the processing proceeds to step S109. In step S109, the CPU 151*a* outputs, to the second control unit 165, an instruction to increase the currently set time Th. An amount of the increase of the time Th may be a predetermined amount or may be determined based on a difference value between the effective value Prms and the threshold Pth.

In this manner, the time Th is set so that the effective value Prms of the power becomes smaller than the threshold Pth when the effective value Prms is greater than or equal to the threshold Pth, thereby preventing supply of excess power to the fixing heater 161. As a result, an increase in power consumption can be prevented. The threshold Pth is set to a value greater than a value of the power with which the temperature of the fixing heater 161 can be increased to the target temperature.

Then, the processing proceeds to step S110.

In step S104, if the effective value Prms of the power is smaller than the threshold Pth (Prms<Pth) (YES in step S104), the processing proceeds to step S105.

In step S105, if the effective value Irms of the current is greater than or equal to a threshold Ith (Irms≥Ith) (NO in step S105), the processing proceeds to step S109. In step S109, the CPU 151*a* outputs, to the second control unit 165, an instruction to increase the currently set time Th. An amount of the increase of the time Th may be a predetermined amount or may be determined based on a difference value between the effective value Irms and the threshold Ith.

In this manner, the time Th is set so that the effective value Irms becomes smaller than the threshold Ith when the effective value Irms is greater than or equal to or the threshold Ith, thereby preventing supply of excess current to the heating element 161*a*. As a result, an excessive increase in the temperature of the fixing heater 161 can be prevented. The threshold Ith is set to a value greater than a value of the current with which the temperature of the fixing heater 161 can be increased to the target temperature.

Then, the processing proceeds to step S110.

In step S105, if the effective value Irms is smaller than the threshold Ith (Irms<Ith) (YES in step S105), the processing proceeds to step S106.

In step S106, if the voltage Vt is equal to the voltage V0 corresponding to the target temperature of the fixing heater 161 (YES in step S106), the processing proceeds to step S110.

In step S106, if the voltage Vt is not equal to the voltage V0 corresponding to the target temperature of the fixing heater 161 (NO in step S106), the processing proceeds to step S107.

In step S107, if the voltage Vt is greater than the voltage V0 (NO in step S107), the processing proceeds to step S109. In step S109, the CPU 151*a* outputs, to the second control unit 165, an instruction to increase the currently set time Th so that a deviation between the voltage Vt and the voltage V0 decreases. An amount of the increase of the time Th may be a predetermined amount or may be determined based on a difference value between the voltage V0 and the voltage Vt.

In step S107, if the voltage Vt is smaller than the voltage V0 (YES in step S107), the processing proceeds to step S108. In step S108, the CPU 151*a* outputs, to the second control unit 165, an instruction to decrease the currently set time Th so that the deviation between the voltage Vt and the voltage V0 decreases. An amount of the decrease of the time Th may be a predetermined amount or may be determined based on the difference value between the voltage V0 and the voltage Vt.

In step S110, if temperature control is continued (i.e., a print job is continued) (NO in step S110), the processing returns to step S102.

In step S110, if the temperature control is finished (i.e., the print job is finished) (YES in step S110), the processing proceeds to step S111. In step S111, the CPU 151*a* stops driving of the triac 167 via the first control unit 164 and the second control unit 165.

For example, a variation in power that varies due to an increase in the time Th is different between when the effective value of the voltage is 100 V and when the effective value of the voltage is 80 V. More specifically, the variation in power that varies due to the increase in the time Th is greater when the effective value of the voltage is 100 V than when the effective value of the voltage is 80 V. The CPU 151*a* controls the time Th based on the effective value Vrms of the voltage.

The method for controlling the temperature of the fixing heater 161 has been described above.

<Antenna ANT>

Power Supply from the Second Control Unit 165 to the First Control Unit 164

The first control unit 164 provided in the first circuit 160*a* is isolated from the second control unit 165 provided in the second circuit 160*b*, and is electromagnetically coupled to the second control unit 165 via the antenna ANT that includes a coil (winding) L1 serving as a first communication unit and a coil (winding) L2 serving as a second communication unit. A high-frequency (e.g., 13.56 MHz) signal with a modulated amplitude is output to the coil L2. An alternating current corresponding to the signal flows through the coil L2, and an AC voltage is generated in the coil L1 by an AC magnetic field generated in the coil L2 due to the flow of the alternating current. The first control unit 164 is operated by the AC voltage generated in the coil L1. Thus, in the present exemplary embodiment, power is supplied to the first control unit 164 from the second control unit 165 via the antenna ANT. As a result, there is no need to provide a power supply for operating the first control unit 164 in the first circuit 160*a*. Accordingly, an increase in size of the image forming apparatus 100 and an increase in costs can be suppressed. The second control unit 165 supplies power to the first control unit 164, for example, in a period shorter than the period in which the first control unit 164 detects the voltage V and the current I. The second control unit 165 does not supply power to the first control unit 164, for example, during a period in which the image forming apparatus 100 is in a sleep state.

Data Communication Between the First Control Unit 164 and the Second Control Unit 165

Figure 6:
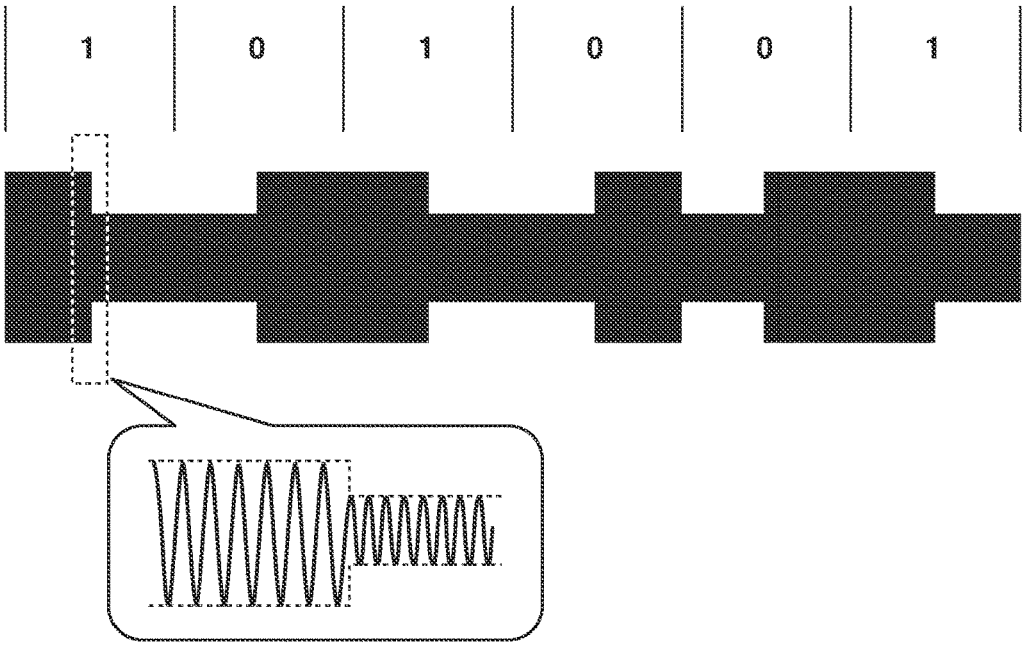
FIG. 6 illustrates an amplitude-modulated wave.

FIG. 6 illustrates an amplitude-modulated signal. As illustrated in FIG. 6, the signal indicates '0' and '1' by a combination of a signal having a first amplitude and a signal having a second amplitude smaller than the first amplitude. For example, in the signal indicating '1', the first half of one bit is constituted of the signal having the first amplitude, and the latter half of one bit is constituted of the signal having the second amplitude. In the signal indicating '0', the first half of one bit is constituted of the signal having the second amplitude, and the latter half of one bit is constituted of the signal having the first amplitude.

The amplitude-modulated signal as illustrated in FIG. 6 is output to the coil L2. As a result, a signal corresponding to the signal output to the coil L2 is generated in the coil L1.

The first control unit 164 changes, for example, the resistance value of a variable resistance provided in the first control unit 164 according to data to be transmitted to the second control unit 165. As a result, the signal generated in the coil L1 changes due to a change in an impedance of the coil L1, and the data is transmitted to the second control unit 165. The first control unit 164 superimposes the data on the signal generated in the coil L1 as described above, thereby transmitting the data to the second control unit 165. The data corresponds to the effective values Vrms, Irms, and Prms, the voltage Vt, the signal ZX indicating the zero crossing timing, and the like.

The second control unit 165 extracts the data from a signal generated in the coil L2 due to the superimposition of the data on the signal generated in the coil L1 by the first control unit 164. More specifically, the second control unit 165 reads the data from the first control unit 164 by detecting a change in the signal generated in the coil L2 due to a change in an impedance of the coil L1 when the first control unit 164 superimposes the data on the signal generated in the coil L1.

In this manner, the first control unit 164 transmits the data to the second control unit 165, which is electromagnetically coupled to the first control unit 164 via the antenna ANT. In other words, the first control unit 164 transmits the data to the second control unit 165 by wireless communication between the coil L1 and the coil L2.

As described above, in the present exemplary embodiment, the first control unit 164 provided in the first circuit 160*a* is isolated from the second control unit 165 provided in the second circuit 160*b*, and is electromagnetically coupled to the second control unit 165 via the antenna ANT including the coil L1 and the coil L2. More specifically, an AC voltage is generated in the coil L1 by the AC magnetic field generated in the coil L2 due to the alternating current flowing through the coil L2 according to the signal output from the second control unit 165. The first control unit 164 is operated by the AC voltage generated in the coil L1. Thus, in the present exemplary embodiment, power is supplied to the first control unit 164 from the second control unit 165 via the antenna ANT. As a result, there is no need to provide a power supply for operating the first control unit 164 in the first circuit 160*a*. Thus, an increase in the size of the image forming apparatus 100 and an increase in costs can be prevented.

In the present exemplary embodiment, the first control unit 164 changes the signal generated in the coil L1 by changing, for example, the impedance of the coil L1, and transmits data to the second control unit 165. The second control unit 165 detects the change, thereby reading the data from the first control unit 164. In this manner, the first control unit 164 transmits the data to the second control unit 165, which is electromagnetically coupled to the first control unit 164 via the antenna ANT. As a result, there is no need to provide a transformer between the first circuit 160*a* and the second circuit 160*b*. Thus, it is possible to prevent an increase in the size of the image forming apparatus 100 and an increase in costs while maintaining the isolated state between the first circuit 160*a* and the second circuit 160*b*.

Furthermore, in the present exemplary embodiment, the voltage Vt output from the A/D converter 153, which is included in the primary side, is input to the first control unit 164, which is included in the primary side. In addition, the triac 167, which is included in the primary side, is controlled by the first control unit 164, which is included in the primary side. As a result, no other configuration for isolating the primary side from the secondary side in the AC driver 160 is provided besides the antenna ANT. Thus, an increase in the size of the image forming apparatus 100 and an increase in costs can be prevented.

In the present exemplary embodiment, ON/OFF control of the relay circuit 166 is performed from the secondary side, i.e., the ON/OFF control of the relay circuit 166 is performed by outputting the signal A from the second control unit 165. However, the present disclosure is not limited to this configuration. For example, the first control unit 164 may perform the ON/OFF control of the relay circuit 166. As a result, no other configuration for isolating the primary side from the secondary side in the AC driver 160 is provided besides the antenna ANT. Thus, an increase in the size of the image forming apparatus 100 and an increase in costs can be prevented.

The functions of the CPU 151*a* in the present exemplary embodiment may be included in the second control unit 165.

The voltage V, the current I, and the like according to the present exemplary embodiment correspond to a parameter related to the power supplied to the load.

The triac 167 according to the present exemplary embodiment is included in each of an adjustment unit and a triac circuit.

In the present exemplary embodiment, the CPU 151*a* acquires the effective values and the voltage Vt when the signal ZX is input. However, the present disclosure is not limited to this configuration. For example, the CPU 151*a* may be configured to acquire the effective values and the voltage Vt when a time measured by a timer provided in the CPU 151*a* reaches a time corresponding to one period of the voltage V. In other words, the signal ZX may not be input to the CPU 151*a* from the second control unit 165.

In the present exemplary embodiment, the configuration for controlling the timing at which the triac 167 is brought into the ON-state is used as the configuration for adjusting power supplied to the heating element 161*a*. However, the present disclosure is not limited to this configuration. For example, there may be used a configuration for adjusting power supplied to the heating element 161*a* by modulating the amplitude of the voltage and current supplied to the heating element 161*a*.

According to the exemplary embodiment of the present disclosure, it is possible to prevent an increase in the size of the image forming apparatus 100.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-235476, filed Dec. 7, 2017, which is hereby incorporated by reference herein in its entirety.

What is claimed is:

1. A power supply apparatus including a first circuit connected to a predetermined power supply, and a second circuit isolated from the first circuit, the power supply apparatus comprising:

an adjustment unit provided in the first circuit and configured to adjust power supplied to a load from the predetermined power supply;

a first controller provided in the first circuit and configured to control the adjustment unit;

a detection unit provided in the first circuit and configured to detect a parameter related to the power supplied to the load;

a first communication unit provided in the first circuit and connected to the first controller;

a second communication unit provided in the second circuit, isolated from the first communication unit, and configured to perform wireless communication with the first communication unit; and a second controller provided in the second circuit and connected to the second communication unit, wherein the first controller is operated with power supplied to the first communication unit by a voltage generated in the first communication unit due to a voltage output from the second controller to the second communication unit, wherein the first controller transmits information about a result of detection by the detection unit to the second controller by the wireless communication, wherein the second controller supplies the first controller with a controlling signal for controlling the adjustment unit via the first communication unit and the second communication unit based on the information transmitted to the second controller from the first controller, and wherein the first controller controls the adjustment unit based on the controlling signal.

2. The power supply apparatus according to claim 1, wherein the parameter related to the power is a current supplied to the load, and wherein the second controller supplies the first controller with a signal, as the controlling signal, for decreasing the power supplied to the load via the first communication unit and the second communication unit in a case where an effective value of the current detected by the detection unit is greater than a first predetermined value.

3. The power supply apparatus according to claim 1, wherein the second controller supplies the first controller with a signal, as the controlling signal for decreasing the power supplied to the load via the first communication unit and the second communication unit in a case where an effective value of power determined based on the result of the detection by the detection unit is greater than a second predetermined value.

4. The power supply apparatus according to claim 1, wherein the detection unit detects a voltage supplied from the predetermined power supply, and wherein the second controller supplies the first controller with the controlling signal via the first communication unit and the second communication unit based on an effective value of the voltage detected by the detection unit.

5. The power supply apparatus according to claim 1, wherein the adjustment unit is a triac circuit, and wherein the second controller increases a period in which the triac circuit is in an ON-state in a case where the power to be supplied to the load is increased, and the second controller decreases the period in which the triac circuit is in the ON-state in a case where the power to be supplied to the load is decreased.

6. The power supply apparatus according to claim 1, wherein the first communication unit includes:

a first antenna including a winding; and a transmission unit configured to transmit the information by controlling an impedance of the winding constituting the first antenna, wherein the second communication unit includes a second antenna including a winding, and wherein the wireless communication between the first communication unit and the second communication unit is performed by the first antenna and the second antenna.

7. The power supply apparatus according to claim 6, wherein the winding constituting the first antenna is connected to a variable resistance, and wherein the first communication unit controls the impedance of the winding constituting the first antenna by changing a resistance value of the variable resistance.

8. The power supply apparatus according to claim 1, wherein the predetermined power supply is a commercial power supply.

9. The power supply apparatus according to claim 1, wherein the detection unit includes a resistor.

10. The power supply apparatus according to claim 1, wherein the first communication unit transmits the information by using a signal generated in the first communication unit due to the voltage output from the second controller to the second communication unit.

11. The power supply apparatus according to claim 1, wherein the first communication unit includes a first antenna including a winding, and wherein the second communication unit includes a second antenna including a winding, and wherein the first controller is operated with power by the voltage generated in the first antenna due to the voltage output from the second controller to the second antenna, the voltage generated in the first antenna being a voltage induced by the voltage output from the second controller to the second antenna.

12. The power supply apparatus according to claim 1, wherein the first communication unit and the second communication unit perform the wireless communication using near-field communication (NFC).

13. An image forming apparatus comprising:

a transfer unit configured to transfer a toner image onto a sheet; and a fixing unit including a heater and configured to fix the toner image, which is transferred onto the sheet by the transfer unit, onto the sheet by heat of the heater, wherein the fixing unit includes:

a first circuit connected to a predetermined power supply;

a second circuit isolated from the first circuit;

an adjustment unit provided in the first circuit and configured to adjust power supplied to the heater from the predetermined power supply;

a first detection unit configured to detect a temperature of the heater;

a first controller provided in the first circuit and configured to control the adjustment unit so that a deviation between a target temperature of the heater and the temperature detected by the first detection unit decreases;

a second detection unit provided in the first circuit and configured to detect a parameter related to the power supplied to the heater;

a first communication unit provided in the first circuit and connected to the first controller;

a second communication unit provided in the second circuit, isolated from the first communication unit, and configured to perform wireless communication with the first communication unit; and a second controller provided in the second circuit and connected to the second communication unit, wherein the first controller is operated with power supplied to the first communication unit by a voltage generated in the first communication unit due to a voltage output from the second controller to the second communication unit, wherein the first controller transmits information about a result of detection by the second detection unit to the second controller by the wireless communication, wherein the second controller supplies the first controller with a controlling signal for controlling the adjustment unit via the first communication unit and the second communication unit, based on the information transmitted to the second controller from the first controller, and wherein the first controller controls the adjustment unit based on the controlling signal.

* * * * *